United States Patent [19]

Mostosi

[11] Patent Number: 4,546,224

[45] Date of Patent: Oct. 8, 1985

[54] ELECTRIC SWITCH IN WHICH THE CONTROL LEVER TRAVEL IS ARRESTED IF THE CONTACTS BECOME WELDED TOGETHER

[75] Inventor: Angelo Mostosi, Bergamo, Italy

[73] Assignee: SACE S.p.A. Costruzioni Elettromeccaniche, Bergamo, Italy

[21] Appl. No.: 538,754

[22] Filed: Oct. 3, 1983

[30] Foreign Application Priority Data

Oct. 7, 1982 [IT] Italy ..... 23118/82[U]

[51] Int. Cl.[4] ..... H01H 5/06

[52] U.S. Cl. ..... 200/153 G; 200/DIG. 42; 335/166

[58] Field of Search ..... 200/153 G, DIG. 42; 335/166, 191

[56] References Cited

U.S. PATENT DOCUMENTS

| | | | |
|---|---|---|---|
| 3,464,040 | 8/1969 | Powell | 335/191 |
| 3,605,052 | 9/1971 | Dimond et al. | 200/DIG. 42 |
| 3,614,685 | 10/1971 | Ellsworth et al. | 335/166 |
| 3,849,751 | 11/1974 | Link et al. | 200/153 G |
| 4,129,762 | 12/1978 | Bruchet | 200/153 G |
| 4,368,444 | 1/1983 | Preuss et al. | 200/DIG. 42 |

*Primary Examiner*—Stephen Marcus
*Assistant Examiner*—Renee S. Kidorf
*Attorney, Agent, or Firm*—Diller, Ramik & Wight

[57] ABSTRACT

An electric switch including fixed and movable contacts, the movable contact being carried by a pivoted arm movable between a first position at which the fixed and movable contacts are in closed contacting relationship and a second position at which the fixed and movable contacts are in open noncontacting relationship, a control lever, a pivot mounting the control lever for movement between first and second positions thereof corresponding to the closed and opened positions respectively of the contacts, a toggle linkage including a plurality of links operatively interconnected between the arm and the control lever, a spring connected between the toggle linkage and the control lever for moving the arm from the first position thereof to the second position thereof and vice versa upon movement of the control lever respectively from the first to the second positions thereof and vice versa absent the contacts being welded together in the closed position thereof, the links being disposed generally in-line in the closed contact position and out of alignment in the opened contact position, the control lever having branches which prevent movement of the control lever to the second position thereof upon the contacts being welded together, the branches being effective to abut a lower portion of the arm during immobilization of the arm due to the welded contacts and the retained in-line relationship of the links as the control lever is moved toward but not to the second position thereof.

9 Claims, 4 Drawing Figures

ELECTRIC SWITCH IN WHICH THE CONTROL LEVER TRAVEL IS ARRESTED IF THE CONTACTS BECOME WELDED TOGETHER

This invention relates to an automatic or non-automatic electric switch which incorporates a mechanism for arresting the control lever travel if the contacts become welded together.

Low-voltage electric switches are known provided with an operating mechanism comprising a control lever which, by way of a toggle lever system on which spiral springs act, causes the mobile contact support arms to snap either into a "switch closed" position with the mobile contacts engaged with the fixed contacts, or into a "switch open" position with the mobile contacts withdrawn from the fixed contacts The control lever extends into an external grip which enables the operator to move the switch from one of said two operating positions to the other.

For safety reasons, the position of the grip must unequivocally indicate the actual position of the mobile switch contacts. However, with the described mechanism, when the switch is operated it would be possible, by forcing, to move the external grip into the position corresponding to the switch open, and to lock it there, for example by padlocks, even if the fixed contacts are welded to the mobile contacts, the consequences then being imaginable.

To obviate this drawback, mechanical arresting devices have been proposed which prevent the grip travelling as far as the "switch open" position if the contacts are welded together. In spite of the validity of these known arresting devices, there is always the need for a very elementary mechanical design which enables the switch constructional costs on a mass-production basis to be limited to a minimum.

The object of the present invention is to provide an automatic or non-automatic electric switch fitted with a device for arresting the control lever travel if the contacts become welded together, which is constructionally simple and operationally effective. This object is attained by an electric switch provided with fixed and mobile contacts carried by relative rigidly interconnected arms, and with a control lever connected to said arms by a toggle lever system in order to suddenly move said arms, by way of return springs, either into a "switch closed" position with said mobile contacts engaged with said fixed contacts, or into a "switch open" position with said mobile contacts withdrawn from said fixed contacts, characterised in that said control lever extends in the form of portions which, if the fixed contacts become welded to the mobile contacts, halt against a corresponding abutment element of one of said contact support arms in an intermediate point of the opening trajectory of said control lever.

The characteristics and advantages of the present invention will be apparent from the description given hereinafter of one embodiment illustrated by way of non-limiting example on the accompanying drawings in which.

Figure 1:
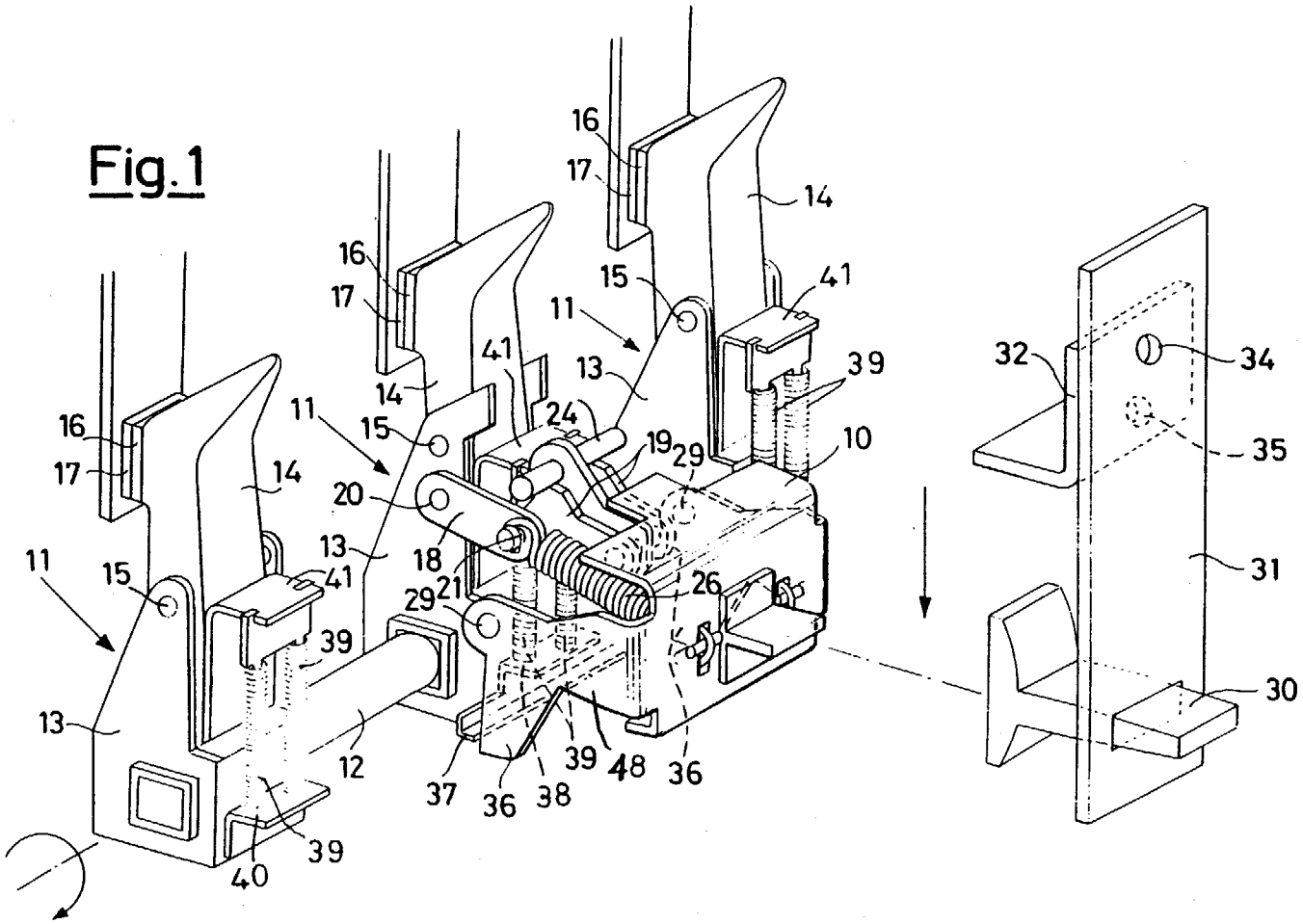
FIG. 1 is a perspective view of the mechanism for operating a three-pole electric switch according to the invention.

In a known configuration, the illustrated mechanism comprises a control lever 10 connected by a toggle lever system to a central contact support arm of a set of three arms 11, which are interconnected to rotate rigidly with each other by a shaft 12 pivoted to the fixed structure of the switch. Each arm 11 is constituted by a fork portion 13 rigidly connected to the shaft 12, and a contact support element 14 pivoted on a pin 15 to the portion 13. The contact 16 is fixed to the contact support element 14, and is mobile into a position corresponding with the relative fixed contact 17.

The toggle lever system is formed from a first pair of plates 18 and a second pair of plates 19. The two plates of each pair operate symmetrically on opposite sides of the central arm 11. The plate 18 visible in the figures is hinged at one end at 20 to one side of the portion 13 of the arm 11, and at its other end at 21 to one end of the relative plate 19. The plate 19 is hinged at its other end at 22 to a bell crank lever 23 rigid with a pin 24 pivoted to the fixed structure of the switch. A spiral spring 26 is stretched between the common point 21 of the two plates 18 and 19 and a point 25 of the control lever 10. The other two plates 18 and 19 on the opposite side connect the portion 13 to the lever 23, and a second spiral spring connects, parallel to the spring 26, the common point of these plates to the control lever 10.

The bell crank lever 23 is halted by a counter-lever 27 pivoted on a pin 28 to the fixed structure. The counter-lever 27 forms part of an automatic release device for the lever 23 for opening the switch contacts under abnormal operating conditions of the electrical system to which the switch is connected. This automatic release device is not described, as it is of known type. The lever 10 is substantially of U shape, and its two branches 48 are pivoted on a pin 29 to the fixed structure. The lever 10 extends to the outside of the switch in the form of a grip 30 encased in a wall 31 mobile along a wall 32 which is rigidly connected to the fixed structure of the switch.

The lever 10 can rotate about the pin 29 between a "switch closed" position (FIG. 2) in which the mobile contacts 16 are engaged with the fixed contacts 17, and a "switch open" position (FIG. 3) in which the mobile contacts 16 are withdrawn from the fixed contacts 17.

The spiral springs 26 which connect the lever 10 to the toggle lever system induce the sudden rotation of the arms 11 into one of the two operating positions, depending on the direction of rotation of the lever 10, on passage through the dead centre in which the axes of the spiral springs are aligned with the axes of the plates 19.

Figure 3:
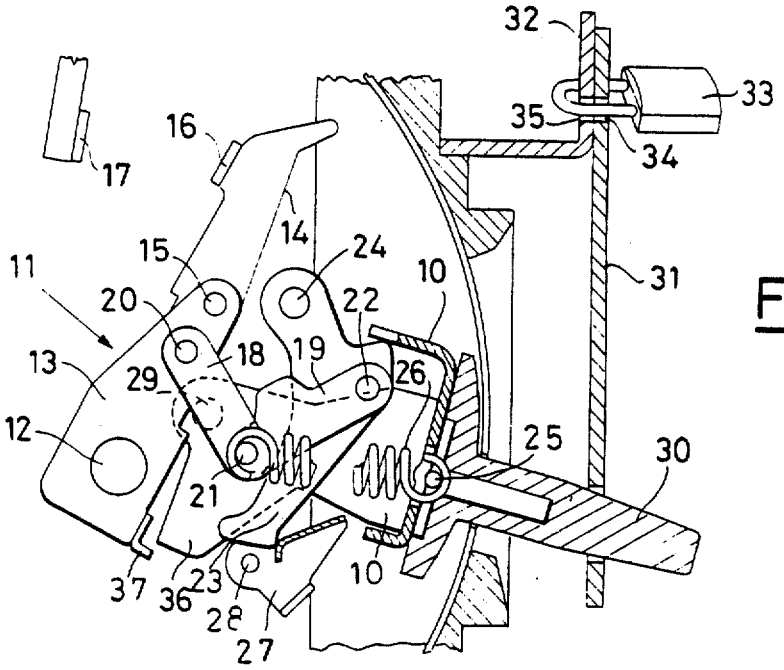

In the "switch open" position, it is possible in known manner to lock the control lever 10 by means of a padlock 33 which passes through a hole 34 in the mobile wall 31 and a corresponding hole 35 in the fixed wall 32. This is because in this operating position, the holes 34 and 35 are aligned in order to enable the grip 30 and thus the lever 10 to be locked, as shown in FIG. 3.

In order to make it impossible to effect this locking by means of forcing if the contacts 16 and 17 become welded together, a mechanism is provided for arresting the control lever travel, and is formed according to the invention by two teeth 36 of the lever 10, which extend from the two branches 48, and by an abutment section 37 fixed to the portion 13 of the arm 11.

Figure 4:
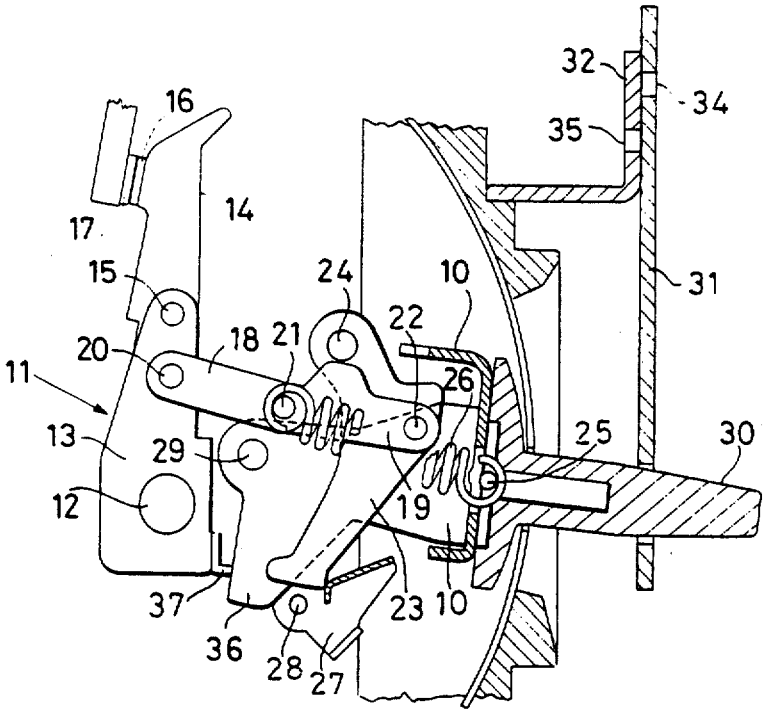

When the contacts become welded together, and thus with the arms 11 in the "switch closed" position, the mutual arrangement of the teeth 36 and section 37 is such that on lowering the grip 30, the teeth 36 collide with and halt against the section 37 before the external grip 30 reaches its end-of-travel position (corresponding to the "switch open"), and thus before the holes 34 and 35 become aligned as shown in FIG. 4.

In this manner it is not possible to padlock the grip 30, even by applying force. Moreover, the arresting of the grip 30 before its end-of-travel position indicates to the operator that the switch contacts have become welded together.

The arresting of the travel of the grip 30 if the contacts become welded together also happens if the automatic release device operates to release the lever 23 by rotation of the counter-lever 27. This is because the movement of the lever 10 relative to the central arm 11 is not influenced by the locking or release state of the lever 23.

Advantageously, the section 37 comprises a bent portion forming a base 38 to which is fixed one end of springs 39 which react against the contact support element 14 of the central arm 11 in order to elastically urge the mobile contacts 16 against the fixed contacts when in the "switch closed" operating position.

These thrust springs are already provided for the contact support arms in the available switches of the type described and illustrated. They operate between a first bracket rigid with one of the two relatively mobile portions of the contact support arm and a second bracket rigid with the other of said two portions. This arrangement is shown in the two side arms 11 of FIG. 1, in particular in the left hand one, where the two springs 39 are provided between two brackets 40 and 41.

In contrast, the central arm 11 comprises, in the mechanism according to the invention, the section 37 which performs the double function of necessary fixing element for the thrust springs 39, and of abutment element for the teeth 36 of the lever 10, thus practically involving no further constructional costs.

A similar consideration can be made in the case of the lever 10. Only the two teeth 36 have to be added to its original U form, and the complete component can be easily constructed from a single piece of plate by punching and bending.

The simplicity and economy of the arresting mechanism according to the invention is accompanied by very high operational reliability. It is apparent that modifications and/or additions can be made to the present embodiment.

In particular, the abutment portions of the control lever, which in the described embodiment are constituted by the teeth 36, can be of different configuration, and the abutment element does not necessarily have to be in the form of the section 37 to which are fixed the thrust springs 39 for the central contact support arm 11. For example, two abutment elements can be provided, formed from a pair of projecting pins fixed to the sides of the central contact support arm and against which corresponding elongated abutment portions of the control lever collide before its end-of-stroke position, when opening the contacts.

I claim:

1. An electric switch comprising fixed (17) and movable (16) contacts, said movable contact (16) being carried by a movable arm (11), means (12) mounting said arm (11) for movement between a first position (FIG. 2) at which said fixed (17) and movable (16) contacts are in closed contacting relationship and a second position (FIG. 3) at which said fixed (17) and movable (16) contacts are in open noncontacting relationship, a control lever (10), means (29) mounting said control lever (10) for movement between first (FIG. 2) and second (FIG. 3) positions thereof corresponding to the closed and open positions respectively of said contacts (16, 17), a toggle linkage (18, 19) including a plurality of links (18, 19) operatively interconnected between said arm (11) and said control lever (10), spring biasing means (26) connected between said toggle linkage (at 21) and said control lever (at 25) for moving said arm (11) from said first position thereof (FIG. 2) to said second position thereof (FIG. 3) and from said second position thereof (FIG. 3) to said first position thereof (FIG. 2) upon movement of said control lever (10) respectively from said first position thereof (FIG. 2) to said second position thereof (FIG. 3) and from said second position thereof (FIG. 3) to said first position thereof (FIG. 2) absent said contacts being welded together in the closed position thereof, said plurality of links (18, 19) being disposed generally in-line in the closed contact position (FIG. 2) and out of alignment in the open contact position (FIG. 3), means (36, 37) for preventing movement of said control lever (10) to said second position thereof (FIG. 3) upon said contacts being welded together (FIG. 4), and said movement preventing means (36, 37) being cooperative abutment means (37) of said arm (11) and abutment means (36) of said control lever (10) which abuttingly contact each other only during immobilization of said arm (11) due to the welded contacts (16, 17, FIG. 4) and the retained in-line relationship of said plurality of links (18, 19) as said control lever (10) is moved toward but not to the second position thereof.

2. The electric switch as defined in claim 1 wherein said control lever (10) includes a generally U-shaped member defined by a bight and a pair of legs (48) and said legs include portions (36) defining said control lever abutment means.

Figure 2:
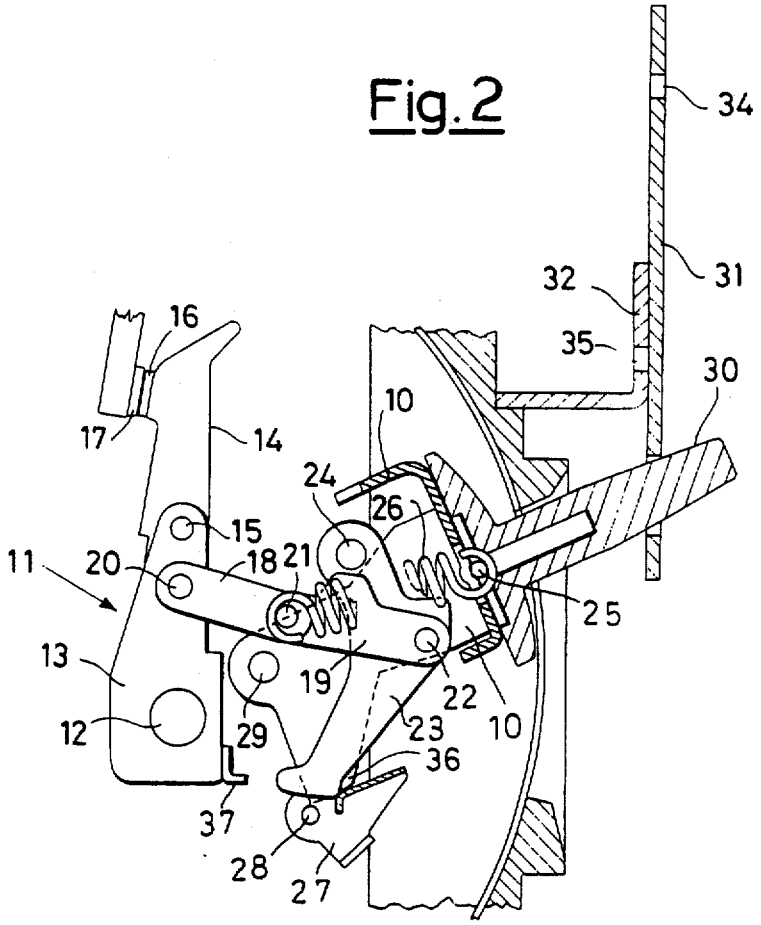
FIGS. 2, 3 and 4 are diagrammatic partial sections through the mechanism of FIG. 1 in a first, second and third operating position respectively.

3. The electric switch as defined in claim 1 wherein said arm abutment means (37) include a flange (38), and spring means (39) between said flange (38) and said arm (11) for urging the latter to its first position (FIG. 2).

4. The electric switch as defined in claim 1 including means (21, 25) connecting said spring biasing means (26) between said plurality of links (18, 19) and said control lever (10), and at least one (25) of said connecting means is disposed at opposite sides of one (19) of said plurality of links (18, 19) when said control lever (10) is in said respective first (FIG. 2) and second (FIG. 3) positions thereof and the contacts (16, 17) are not welded to each other and is also disposed at the same side of one (19) of said plurality of links (18, 19) when said links are in-line and said contacts (16, 17) are both closed (FIG. 2) or welded together (FIG. 4).

5. The electric switch as defined in claim 4 wherein said control lever (10) includes a generally U-shaped member defined by a bight and a pair of legs (48) and said legs include portions (36) defining said control lever abutment means.

6. The electric switch as defined in claim 4 wherein said arm abutment means (37) include a flange (38), and spring means (39) between said flange (38) and said arm (11) for urging the latter to its first position (FIG. 2).

7. The electric switch as defined in claim 1 including means (21) connecting together said plurality of links (18, 19), means 20, 22 for connecting one each of said plurality of links (18, 19) to one each of said arm (11) and control lever (10), said last-mentioned link connecting means (20, 21, 22) being disposed generally in-line when said links (18, 19) are in-line (FIGS. 2 and 4) and out of alignment (FIG. 3) when said links are out of alignment, means (25) connecting said spring biasing means (26) to said control lever (10), and said last-mentioned connecting means (25) is disposed on opposite sides of one (19) of said links (18, 19) in the in-line position thereof when said contacts are both closed (FIG. 2) and welded together (FIG. 4).

8. The electric switch as defined in claim 7 wherein said control lever (10) includes a generally U-shaped member defined by a bight and a pair of legs (48) and said legs include portions (36) defining said control lever abutment means.

9. The electric switch as defined in claim 7 wherein said arm abutment means (37) include a flange (38), and spring means (39) between said flange (38) and said arm (11) for urging the latter to its first position (FIG. 2).

* * * * *

UNITED STATES PATENT AND TRADEMARK OFFICE

CERTIFICATE OF CORRECTION

PATENT NO. : 4,546,224

Pg 1 of 4

DATED : October 8, 1985

INVENTOR(S) : Angelo Mostosi

It is certified that error appears in the above-identified patent and that said Letters Patent is hereby corrected as shown below:

Delete columns 1-18, and substitute the attached columns 1-6.

Signed and Sealed this

*Nineteenth* Day of *August 1986*

[SEAL]

*Attest:*

DONALD J. QUIGG

*Attesting Officer*

*Commissioner of Patents and Trademarks*

ELECTRIC SWITCH IN WHICH THE CONTROL LEVER TRAVEL IS ARRESTED IF THE CONTACTS BECOME WELDED TOGETHER

This invention relates to an automatic or non-automatic electric switch which incorporates a mechanism for arresting the control lever travel if the contacts become welded together.

Low-voltage electric switches are known provided with an operating mechanism comprising a control lever which, by way of a toggle lever system on which spiral springs act, causes the mobile contact support arms to snap either into a "switch closed" position with the mobile contacts engaged with the fixed contacts, or into a "switch open" position with the mobile contacts withdrawn from the fixed contacts The control lever extends into an external grip which enables the operator to move the switch from one of said two operating positions to the other.

For safety reasons, the position of the grip must unequivocally indicate the actual position of the mobile switch contacts. However, with the described mechanism, when the switch is operated it would be possible, by forcing, to move the external grip into the position corresponding to the switch open, and to lock it there, for example by padlocks, even if the fixed contacts are welded to the mobile contacts, the consequences then being imaginable.

To obviate this drawback, mechanical arresting devices have been proposed which prevent the grip travelling as far as the "switch open" position if the contacts are welded together. In spite of the validity of these known arresting devices, there is always the need for a very elementary mechanical design which enables the switch constructional costs on a mass-production basis to be limited to a minimum.

The object of the present invention is to provide an automatic or non-automatic electric switch fitted with a device for arresting the control lever travel if the contacts become welded together, which is constructionally simple and operationally effective. This object is attained by an electric switch provided with fixed and mobile contacts carried by relative rigidly interconnected arms, and with a control lever connected to said arms by a toggle lever system in order to suddenly move said arms, by way of return springs, either into a "switch closed" position with said mobile contacts engaged with said fixed contacts, or into a "switch open" position with said mobile contacts withdrawn from said fixed contacts, characterised in that said control lever extends in the form of portions which, if the fixed contacts become welded to the mobile contacts, halt against a corresponding abutment element of one of said contact support arms in an intermediate point of the opening trajectory of said control lever.

The characteristics and advantages of the present invention will be apparent from the description given hereinafter of one embodiment illustrated by way of non-limiting example on the accompanying drawings in which:

FIG. 1 is a perspective view of the mechanism for operating a three-pole electric switch according to the invention;

FIGS. 2, 3 and 4 are diagrammatic partial sections through the mechanism of FIG. 1 in a first, second and third operating position respectively.

In a known configuration, the illustrated mechanism comprises a control lever 10 connected by a toggle lever system to a central contact support arm of a set of three arms 11, which are interconnected to rotate rigidly with each other by a shaft 12 pivoted to the fixed structure of the switch. Each arm 11 is constituted by a fork portion 13 rigidly connected to the shaft 12, and a contact support element 14 pivoted on a pin 15 to the portion 13. The contact 16 is fixed to the contact support element 14, and is mobile into a position corresponding with the relative fixed contact 17.

The toggle lever system is formed from a first pair of plates 18 and a second pair of plates 19. The two plates of each pair operate symmetrically on opposite sides of the central arm 11. The plate 18 visible in the figures is hinged at one end at 20 to one side of the portion 13 of the arm 11, and at its other end at 21 to one end of the relative plate 19. The plate 19 is hinged at its other end at 22 to a bell crank lever 23 rigid with a pin 24 pivoted to the fixed structure of the switch. A spiral spring 26 is stretched between the common point 21 of the two plates 18 and 19 and a point 25 of the control lever 10. The other two plates 18 and 19 on the opposite side connect the portion 13 to the lever 23, and a second spiral spring connects, parallel to the spring 26, the common point of these plates to the control lever 10.

The bell crank lever 23 is halted by a counter-lever 27 pivoted on a pin 28 to the fixed structure. The counter-lever 27 forms part of an automatic release device for the lever 23 for opening the switch contacts under abnormal operating conditions of the electrical system to which the switch is connected. This automatic release device is not described, as it is of known type. The lever 10 is substantially of U shape, and its two branches 48 are pivoted on a pin 29 to the fixed structure. The lever 10 extends to the outside of the switch in the form of a grip 30 encased in a wall 31 mobile along a wall 32 which is rigidly connected to the fixed structure of the switch.

The lever 10 can rotate about the pin 29 between a "switch closed" position (FIG. 2) in which the mobile contacts 16 are engaged with the fixed contacts 17, and a "switch open" position (FIG. 3) in which the mobile contacts 16 are withdrawn from the fixed contacts 17.

The spiral springs 26 which connect the lever 10 to the toggle lever system induce the sudden rotation of the arms 11 into one of the two operating positions, depending on the direction of rotation of the lever 10, on passage through the dead centre in which the axes of the spiral springs are aligned with the axes of the plates 19.

In the "switch open" position, it is possible in known manner to lock the control lever 10 by means of a padlock 33 which passes through a hole 34 in the mobile wall 31 and a corresponding hole 35 in the fixed wall 32. This is because in this operating position, the holes 34 and 35 are aligned in order to enable the grip 30 and thus the lever 10 to be locked, as shown in FIG. 3.

In order to make it impossible to effect this locking by means of forcing if the contacts 16 and 17 become welded together, a mechanism is provided for arresting the control lever travel, and is formed according to the invention by two teeth 36 of the lever 10, which extend from the two branches 48, and by an abutment section 37 fixed to the portion 13 of the arm 11.

When the contacts become welded together, and thus with the arms 11 in the "switch closed" position, the mutual arrangement of the teeth 36 and section 37 is such that on lowering the grip 30, the teeth 36 collide with and halt against the section 37 before the external grip 30 reaches its end-of-travel position (corresponding to the "switch open"), and thus before the holes 34 and 35 become aligned as shown in FIG. 4.

In this manner it is not possible to padlock the grip 30, even by applying force. Moreover, the arresting of the grip 30 before its end-of-travel position indicates to the operator that the switch contacts have become welded together.

The arresting of the travel of the grip 30 if the contacts become welded together also happens if the automatic release device operates to release the lever 23 by rotation of the counter-lever 27. This is because the movement of the lever 10 relative to the central arm 11 is not influenced by the locking or release state of the lever 23.

Advantageously, the section 37 comprises a bent portion forming a base 38 to which is fixed one end of springs 39 which react against the contact support element 14 of the central arm 11 in order to elastically urge the mobile contacts 16 against the fixed contacts when in the "switch closed" operating position.

These thrust springs are already provided for the contact support arms in the available switches of the type described and illustrated. They operate between a first bracket rigid with one of the two relatively mobile portions of the contact support arm and a second bracket rigid with the other of said two portions. This arrangement is shown in the two side arms 11 of FIG. 1, in particular in the left hand one, where the two springs 39 are provided between two brackets 40 and 41.

In contrast, the central arm 11 comprises, in the mechanism according to the invention, the section 37 which performs the double function of necessary fixing element for the thrust springs 39, and of abutment element for the teeth 36 of the lever 10, thus practically involving no further constructional costs.

A similar consideration can be made in the case of the lever 10. Only the two teeth 36 have to be added to its original U form, and the complete component can be easily constructed from a single piece of plate by punching and bending.

The simplicity and economy of the arresting mechanism according to the invention is accompanied by very high operational reliability. It is apparent that modifications and/or additions can be made to the present embodiment.

In particular, the abutment portions of the control lever, which in the described embodiment are constituted by the teeth 36, can be of different configuration, and the abutment element does not necessarily have to be in the form of the section 37 to which are fixed the thrust springs 39 for the central contact support arm 11. For example, two abutment elements can be provided, formed from a pair of projecting pins fixed to the sides of the central contact support arm and against which corresponding elongated abutment portions of the control lever collide before its end-of-stroke position, when opening the contacts.

I claim:

1. An electric switch comprising fixed (17) and movable (16) contacts, said movable contact (16) being carried by a movable arm (11), means (12) mounting said arm (11) for movement between a first position (FIG. 2) at which said fixed (17) and movable (16) contacts are in closed contacting relationship and a second position (FIG. 3) at which said fixed (17) and movable (16) contacts are in open noncontacting relationship, a control lever (10), means (29) mounting said control lever (10) for movement between first (FIG. 2) and second (FIG. 3) positions thereof corresponding to the closed and open positions respectively of said contacts (16, 17), a toggle linkage (18, 19) including a plurality of links (18, 19) operatively interconnected between said arm (11) and said control lever (10), spring biasing means (26) connected between said toggle linkage (at 21) and said control lever (at 25) for moving said arm (11) from said first position thereof (FIG. 2) to said second position thereof (FIG. 3) and from said second position thereof (FIG. 3) to said first position thereof (FIG. 2) upon movement of said control lever (10) respectively from said first position thereof (FIG. 2) to said second position thereof (FIG. 3) and from said second position thereof (FIG. 3) to said first position thereof (FIG. 2) absent said contacts being welded together in the closed position thereof, said plurality of links (18, 19) being disposed generally in-line in the closed contact position (FIG. 2) and out of alignment in the open contact position (FIG. 3), means (36, 37) for preventing movement of said control lever (10) to said second position thereof (FIG. 3) upon said contacts being welded together (FIG. 4), and said movement preventing means (36, 37) being cooperative abutment means (37) of said arm (11) and abutment means (36) of said control lever (10) which abuttingly contact each other only during immobilization of said arm (11) due to the welded contacts (16, 17, FIG. 4) and the retained in-line relationship of said plurality of links (18, 19) as said control lever (10) is moved toward but not to the second position thereof.

2. The electric switch as defined in claim 1 wherein said control lever (10) includes a generally U-shaped member defined by a bight and a pair of legs (48) and said legs include portions (36) defining said control lever abutment means.

3. The electric switch as defined in claim 1 wherein said arm abutment means (37) include a flange (38), and spring means (39) between said flange (38) and said arm (11) for urging the latter to its first position (FIG. 2).

4. The electric switch as defined in claim 1 including means (21, 25) connecting said spring biasing means (26) between said plurality of links (18, 19) and said control lever (10), and at least one (25) of said connecting means is disposed at opposite sides of one (19) of said plurality of links (18, 19) when said control lever (10) is in said respective first (FIG. 2) and second (FIG. 3) positions thereof and the contacts (16, 17) are not welded to each other and is also disposed at the same side of one (19) of said plurality of links (18, 19) when said links are in-line and said contacts (16, 17) are both closed (FIG. 2) or welded together (FIG. 4).

5. The electric switch as defined in claim 4 wherein said control lever (10) includes a generally U-shaped member defined by a bight and a pair of legs (48) and said legs include portions (36) defining said control lever abutment means.

6. The electric switch as defined in claim 4 wherein said arm abutment means (37) include a flange (38), and spring means (39) between said flange (38) and said arm (11) for urging the latter to its first position (FIG. 2).

7. The electric switch as defined in claim 1 including means (21) connecting together said plurality of links (18, 19), means 20, 22 for connecting one each of said plurality of links (18, 19) to one each of said arm (11) and control lever (10), said last-mentioned link connecting means (20, 21, 22) being disposed generally Pg 4 of 4 in-line when said links (18, 19) are in-line (FIGS. 2 and 4) and out of alignment (FIG. 3) when said links are out of alignment, means (25) connecting said spring biasing means (26) to said control lever (10), and said last-mentioned connecting means (25) is disposed on opposite sides of one (19) of said links (18, 19) in the in-line position thereof when said contacts are both closed (FIG. 2) and welded together (FIG. 4).

8. The electric switch as defined in claim 7 wherein said control lever (10) includes a generally U-shaped member defined by a bight and a pair of legs (48) and said legs include portions (36) defining said control lever abutment means.

9. The electric switch as defined in claim 7 wherein said arm abutment means (37) include a flange (38), and spring means (39) between said flange (38) and said arm (11) for urging the latter to its first position (FIG. 2).

* * * * *